US005259136A

United States Patent [19]

Goserud

[11] Patent Number: 5,259,136

[45] Date of Patent: Nov. 9, 1993

[54] HOLDER FOR PROTECTIVELY DISPLAYING COLLECTIBLE CARDS

[76] Inventor: J. Thomas Goserud, 13818 Sutters Mill Rd., Midlothian, Va. 23112

[21] Appl. No.: 914,317

[22] Filed: Jul. 17, 1992

Related U.S. Application Data

[63] Continuation-in-part of Ser. No. 761,513, Sep. 18, 1991.

[51] Int. Cl.[5] ..... G09F 3/18

[52] U.S. Cl. ..... 40/642; 40/158.1

[58] Field of Search ..... 40/661, 158.1, 649, 40/156, 159.2

[56] References Cited

U.S. PATENT DOCUMENTS

| | | | |
|---|---|---|---|
| 318,908 | 5/1885 | Johnson | 40/156 |
| 3,357,773 | 12/1967 | Rowland | 40/427 X |
| 3,707,053 | 12/1972 | Itano | 40/158.1 |
| 4,145,829 | 3/1979 | Peltier | 40/158.1 |
| 4,413,434 | 11/1983 | Rupert et al. | 40/661 |
| 4,682,430 | 7/1987 | Ramsay | 40/649 X |
| 5,074,067 | 12/1991 | Cohart | 40/158.1 |

*Primary Examiner*—Kenneth J. Dorner
*Assistant Examiner*—J. Bonifanti
*Attorney, Agent, or Firm*—Norman B. Rainer

[57] ABSTRACT

A holder for a collectible card is constructed of a flexible jacket having two identical transparent panels of rectangular perimeter defined by four straight exterior edges and bonded together along three of the edges. The unbonded fourth exterior edges provide an entrance opening to the jacket. A flexible thin insert member completely fills the jacket except for an aperture of rectangular configuration in the insert member disposed in parallel relationship to the perimeter of the panels. The aperture is defined by four straight interior edges. That interior edge which is parallel to and adjacent the entrance opening serves to retain a collectible card within the aperture, preventing inadvertent release of the card from the aperture.

1 Claim, 1 Drawing Sheet

HOLDER FOR PROTECTIVELY DISPLAYING COLLECTIBLE CARDS

RELATED APPLICATIONS

This application is a continuation-in-part of U.S. patent application Ser. No. 07/761,513, filed Sep. 18, 1991.

BACKGROUND OF THE INVENTION

1. Field of the Invention

This invention concerns a holder for projecting and displaying flat objects, and more particularly relates to a holder which visually enhances both sides of collectible sports cards.

2. Description of the Prior Art

It is often sought to protectively display a flat rectangular object such as a photograph or collectible sports card with the addition of a surrounding border than enhances the appearance of the object. In the case of collectible sports cards, it is important to be able to view both sides of the card.

Sports cards are generally of elongated rectangular shape, and depict professional players in sports such as baseball, football, basketball, hockey, soccer, wrestling, tennis, golf, auto racing, and other sports. The depiction is generally in the form of photographs which appear on both faces of the card. Performance statistics, team affiliation, special accomplishments, and other information relevant to the player and/or sport may also be printed on either or both faces of the card.

The economic value of the card is dependent in part upon its physical condition. Accordingly, any display-type holder should also protect the card from the affects of handling and exposure to air, humidity and strong light. It is nevertheless desirable that the card be easily removable and a replacement card be easily insertable.

Although protective display holders for collectible cards have earlier been disclosed, they are in general of complicated construction, expensive, or difficult to utilize. Most such earlier holders do little to enhance the appearance of the card.

It is accordingly an object of the present invention to provide a holder device for protectively displaying collectible cards.

It is another object of this invention to provide a holder as in the foregoing object which permits easy insertion and removal of a collectible card.

It is a further object of the invention to provide a holder of the aforesaid nature which enhances the appearance of one or both surfaces of a collectible card, and is of durable, simple construction amenable to low cost manufacture.

These objects and other objects and advantages of the invention will be apparent from the following description.

SUMMARY OF THE INVENTION

The above and other beneficial objects and advantages are accomplished in accordance with the present invention by a holder comprised of:

a) a jacket comprised of two identical panels of semi-rigid non-breakable transparent plastic bounded by four straight edges in a rectangular configuration elongated upon a center axis, said panels disposed one atop the other and sealed together along three edges whereby the unsealed fourth edges define an entrance opening to an enclosure bounded by said panels, b) an insert member disposed within said enclosure and comprised of a piece of flexible sheet material having a thickness and outer perimeter adapted to perfectly fill said enclosure, and having a substantially centered aperture of elongated rectangular configuration having a long axis disposed coaxially with the center axis of the jacket, and c) retaining means that ensures proper positioning of a collectible card within said aperture and prevents inadvertent removal of said card from said holder.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
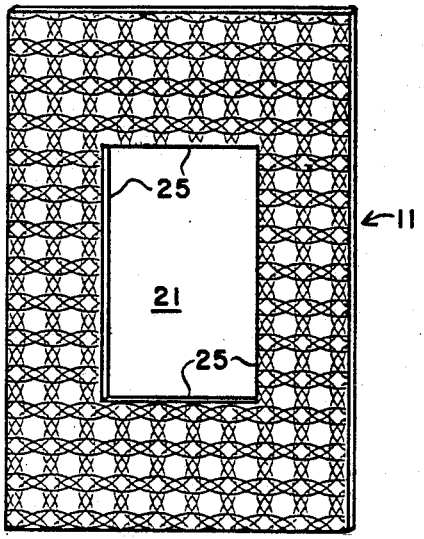
FIG. 2 is a top plan view of the holder of FIG. 1 shown holding a sports card.
Figure 2:
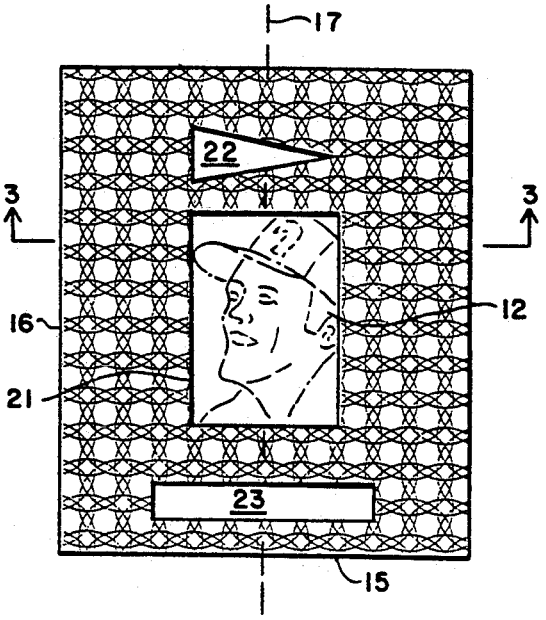

Referring to FIGS. 1–4, an embodiment of the holder of the present invention is shown comprised of jacket 10 and insert member 11 emplaced within said jacket. A sports card 12 is shown properly emplaced within the holder.

Jacket 10 is formed from identical top and bottom panels 13 and 14, respectively, fabricated of semi-rigid non-breakable transparent plastic sheet material. Suitable plastics include plasticized polyvinyl chloride, polycarbonate, polyacrylic esters, and ionomer resins. Said panels or sheets are of elongated rectangular configuration, bounded by opposed short exterior edges 15 and long exterior edges 16, and having a center axis 17 parallel to said long edges and midway therebetween. Said sheets or panels are disposed one atop the other and sealed together along three of said exterior edges. The sealing is preferably achieved by way of cohesive bonding techniques involving controlled thermal fusion of the plastic. Exemplary cohesive bonding techniques include ultrasonic welding, microwave heating, and use of heated platens or rollers.

The sheets will typically have a uniform thickness in the range of about 0.2 to 1.0 millimeter. The length of the jacket, measured orthogonally between short edges 15 will be in the range of about 13 to 20 cm. The width of the jacket, measured between long exterior edges 16 will be in the range of about 9 to 14 cm. The ratio of length to width is preferably within the range of about 1.1 to 1.6.

The sealed sheets define an enclosure 19 bounded by said sheets and three sealed exterior edges. The unsealed fourth exterior edges of said sheets define an entrance opening 20 providing access to enclosure 19. By virtue of the semi-rigid, flexible nature of the sheets and insert member 11, the jacket can be flexed by squeezing together two opposed sealed exterior edges, thereby causing the unsealed fourth exterior edges to separate to produce a momentarily enlarged entrance opening. Alternatively, the entrance opening may be enlarged by pulling apart said unsealed fourth edges.

The enlarged entrance opening facilitates insertion and removal of a collectible card.

In an alternative embodiment, jacket 10 may be produced by flatening a tubular configuration of an appropriate thermoplastic at heat setting temperatures, followed by cutting transversely at uniform intervals and thermally sealing the edges at one cut extremity. The jacket thereby formed is of monolithic construction. As one illustration of such manner of production, a continuous extruded tube of thermoplastic would be passed through interactive rollers heated to a temperature corresponding to the softening point of the thermoplastic.

Insert member 11 is a monolithic piece of semi-rigid sheet material having a uniform thickness of between about 0.2 mm and 1.0 mm and comparable to the thickness of sheets 13 and 14, and having an outer rectangular perimeter dimensioned to exactly fit within said enclosure. An aperture 21 of elongated rectangular configuration and defined by four straight interior edges 25 is substantially centrally disposed within said insert member in a manner wherein the long axis of aperture 21 is coaxially disposed with center axis 17 of jacket 10 when said insert member is properly disposed within said jacket. Said insert member may be slidably removable, but is preferably secured within the enclosure by virtue of the same type of bonding employed to seal the edges of the sheets of jacket 10. Insert member 11 is preferably fabricated of plastic material whose front and rear surfaces are modified so as to impart special optical or illusory effects. In particular, the preferred specialized optical effect is one which produces a perception of depth. Modified surfaces that provide suitable optical illusions are described for example in U.S. Pat. Nos. 3,357,772; 3,357,773 and 3,893,795. In general, the illusory effects are produced in an otherwise transparent plastic sheet by curvilinear lens-like embossments disposed on the front surface of the sheet and a multiplicity of closely spaced reflective embossments on the rear surface.

Figure 1:
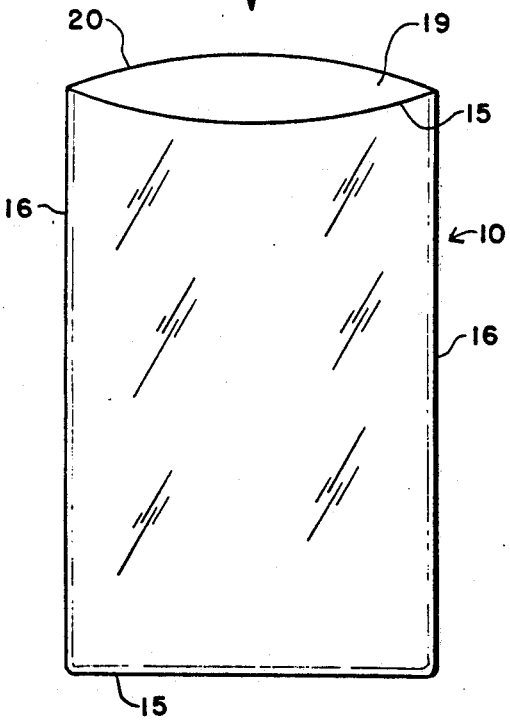
FIG. 1 is an exploded front perspective view of an embodiment of the holder of the present invention.
Figure 4:
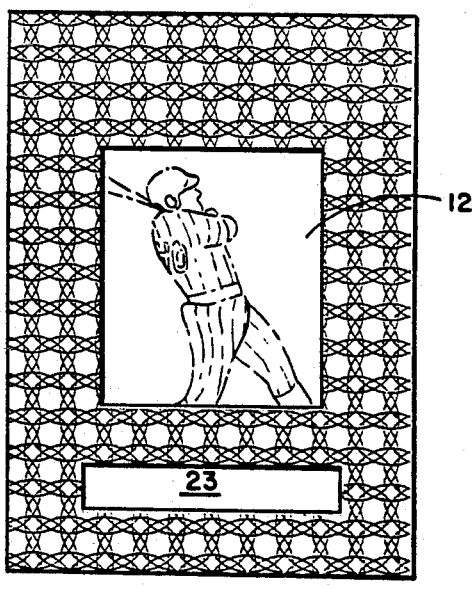
FIG. 4 is a rear view of the holder of FIG. 1.
Figure 3:
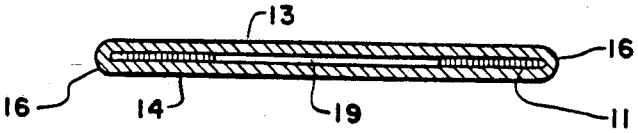
FIG. 3 is a sectional view taken upon the line 3—3 of FIG. 2.

In the embodiment exemplified in FIG. 1, opening 20 is provided at the top of the jacket, namely in association with short edges 15. In alternative embodiments however, opening 20 may be associated with a side of the jacket, namely with long edges 16.

The insert member serves the following several purposes: A) the interior edge 25 adjacent entrance opening 20 serves as retaining means which prevents inadvertent emergence of a card from the holder, B) it automatically centers the card within the jacket, C) it functions as a separator to prevent sheets 13 and 14 from pressing hard upon the surfaces of the card, and D) in the preferred embodiment, it causes the card to appear as though it is either recessed behind or floating atop the plane of the holder when viewed from above top sheet 13. Because of its flexible nature, the insert member permits momentary enlargement of entrance opening 20 and facilitates insertion of a collectible card into aperture 21 without requiring bending of the card.

In alternative embodiments of the holder, the retaining means may be an inwardly directed lip associated with an exterior edge of opening 20. Such lip may be formed within sheet 13 or 14 by virtue of a thermal forming or molding operation, and may be formed before or after production of the jacket.

Aperture 21 is cut so as to exactly fit the collectible card. Other flat items may be placed within the jacket either by being attached to the faces of the insert member, or by being recessed into auxiliary apertures fashioned into the insert member. For example, a pennant or flag 22 may be employed, or rectangular cards or papers 23 containing printed indicia associated with the player whose picture appears on the card. By virtue of the aforesaid components and their interaction, the flat collectible card is protectively enclosed in a holder that enhances the appearance of both sides of the card. The assembled holder, containing the collectible card is sufficiently rigid so that it can be supported in a substantially upright position by a stand. In view of the relatively flat nature of the holder, it can be stored in stacks that occupy relatively little space.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A holder for a collectable card comprised of:

a) a jacket comprised of two identical panels of semi-rigid non-breakable transparent plastic bounded by four straight exterior edges in a rectangular configuration elongated upon a center axis, said panels disposed one atop the other and sealed together along three edges, whereby the unsealed fourth exterior edges define an entrance opening to an enclosure bounded by said panels b) an insert member disposed within said enclosure and comprised of a monolithic piece of plastic sheet material having a thickness between about 0.2 mm and 1.0 mm and whose front and rear surfaces provide an illusory effect of depth, said insert member having a particular thickness and outer perimeter as to perfectly fill said enclosure, and having a substantially centered aperture of elongated rectangular configuration defined by four straight interior edges and having a long axis disposed coaxially with said center axis, and c) retaining means comprised of one of said interior edges disposed adjacent and parallel to said entrance opening, thereby ensuring proper positioning of a collectible card within said aperture and preventing inadvertent removal of said card from said holder.

* * * * *